United States Patent [19]

Lutringer

[11] 3,967,643

[45] July 6, 1976

[54] SPLASH GUARD

[76] Inventor: Cleo Margaret Lutringer, Rte. 1, Box 180, El Campo, Tex. 77437

[22] Filed: Aug. 26, 1974

[21] Appl. No.: 500,901

[52] U.S. Cl. ..... 137/562; 137/801; 285/8

[51] Int. Cl.[2] ..... E03C 1/00

[58] Field of Search ..... 137/562, 799, 801; 138/122; 285/8; 417/181

[56] References Cited

UNITED STATES PATENTS

| | | | |
|---|---|---|---|
| 1,630,543 | 5/1927 | Scott | 417/181 |
| 1,762,518 | 6/1930 | MacKenzie | 285/8 X |
| 1,950,172 | 3/1934 | Gavaza | 137/562 X |
| 2,699,357 | 1/1955 | Roth | 285/8 X |
| 2,711,331 | 6/1955 | Temple | 285/8 |
| 2,927,625 | 3/1960 | Rothermel et al. | 138/122 X |
| 2,954,802 | 10/1960 | Duff | 138/122 |
| 3,339,587 | 9/1967 | Dicken | 137/562 X |

FOREIGN PATENTS OR APPLICATIONS

| | | | |
|---|---|---|---|
| 151,609 | 3/1932 | Switzerland | 137/801 |

*Primary Examiner*—William R. Cline
*Assistant Examiner*—Gerald A. Michalsky
*Attorney, Agent, or Firm*—Clarence A. O'Brien; Harvey B. Jacobson

[57] ABSTRACT

A splash guard for use with a combined appliance filling and draining faucet attachment has a sleeve arranged covering a collapsible framework formed by a coiled resilient element. The sleeve forms an inlet and outlet to the framework through which a fluid may pass, with a fitting being arranged blocking the inlet for facilitating attachment of the guard to a faucet attachment, and the like.

3 Claims, 4 Drawing Figures

Fig. 1
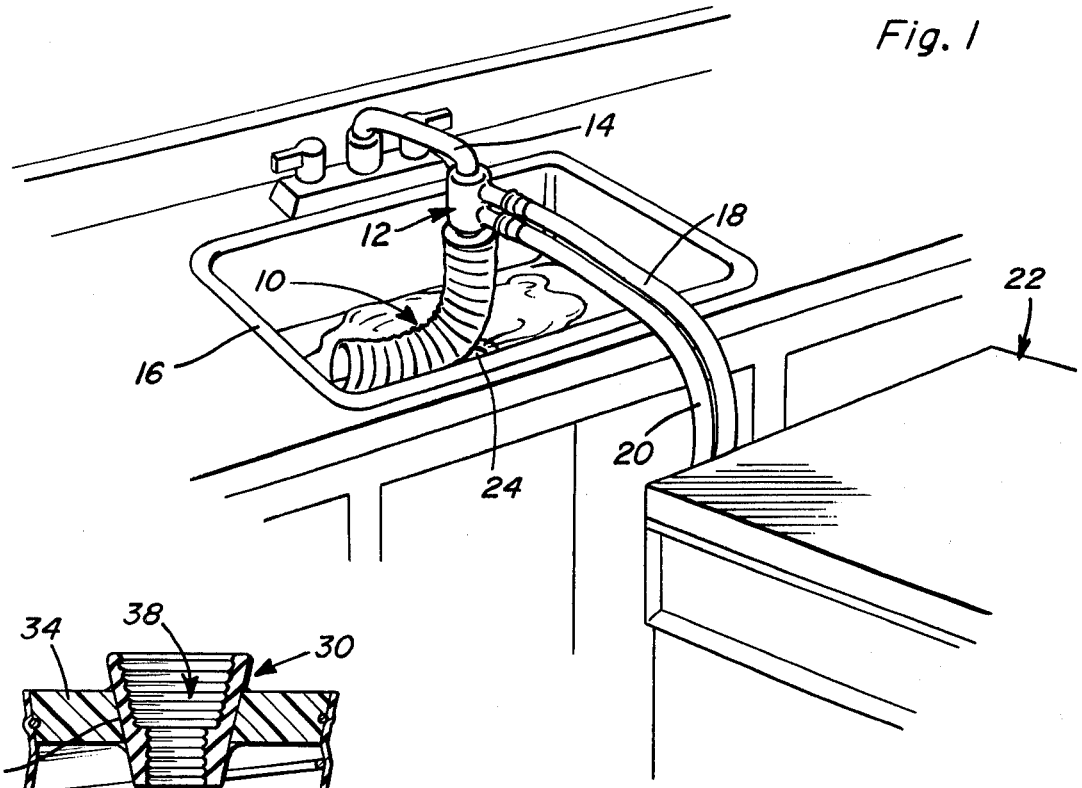
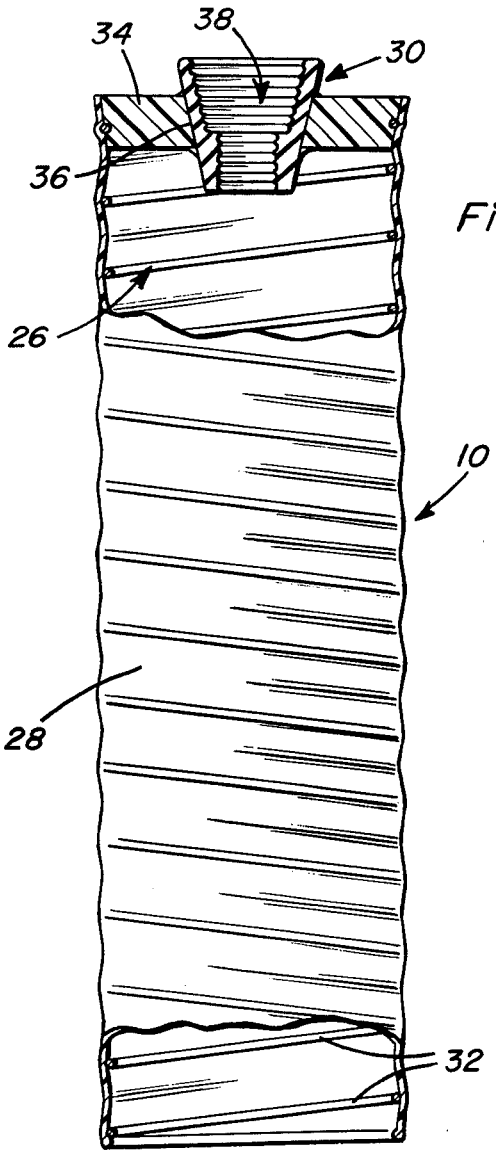
Fig. 2
Fig. 3
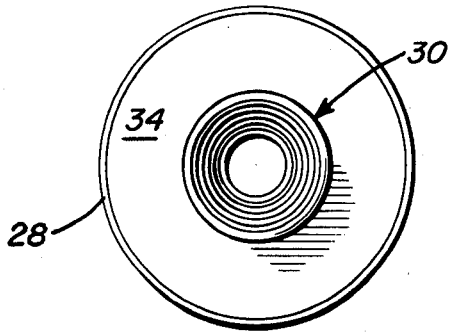
Fig. 4
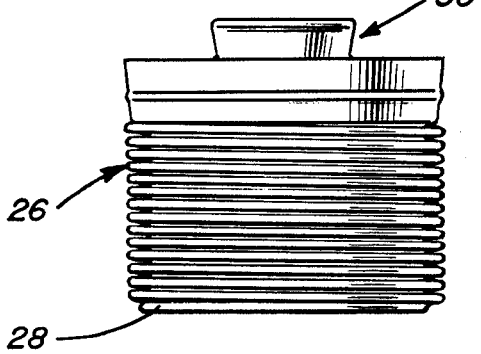

SPLASH GUARD

BACKGROUND OF THE INVENTION

1. Field of the Invention

This invention relates generally to a splash guard, and particularly to a splash guard for use with a combined filling and draining faucet attachment such as commonly employed with dishwashers and similar appliances.

2. Description of the Prior Art

Dish and laundry washing machines, and the like, are well known and commonly used that employ a conventional sink as a source of water and as a drain. To facilitate filling and draining of a machine, devices such as shown in U.S. Pat. No. 1,950,172, issued Mar. 6, 1934 to G. V. Gavaza, and U.S. Pat. No. 3,339,587, issued Sept. 5, 1967 to J. A. Dicken, Jr., are employed to attach the machine hoses to a faucet and to drain water into the sink associated with the faucet.

A difficulty encountered with the use of the devices referred to above, however, is that the water from the discharge nozzle of the device tends to splash in the sink and splatter out of same. Accordingly, it has been proposed, such as shown in the aforementioned U.S. Pat. No. 1,950,172, to associate specially constructed appliances with the filling and draining devices in order to prevent such splashing.

Additional prior patents believed to be pertinent to the present invention are as follows:

| | | |
|---|---|---|
| 1,218,695 | T. E. Phillips | Mar. 13, 1917 |
| 1,264,679 | F. J. Teck | Apr. 30, 1918 |
| 1,290,736 | J. C. Greenberg | Jan. 7, 1919 |
| 1,645,227 | N. W. Cease | Oct. 11, 1927 |
| 3,131,954 | V. M. Kramer, et al | May 5, 1964 |
| 3,529,775 | W. A. Eckerle | Sept. 22, 1970 |

SUMMARY OF THE INVENTION

It is an object of the present invention to provide a splash guard compatible with the discharge hoses of both conventional portable washing machines and portable dishwashing machines.

It is another object of the present invention to provide a splash guard of inexpensive and lightweight, yet rugged construction.

It is yet another object of the present invention to provide a splash guard that is collapsible and easily stored.

It is a still further object of the present invention to provide a splash guard capable of fitting almost any size hose and adaptable to discharge from nearly any high pressure source.

These and other objects are achieved according to the present invention by providing a splash guard having: a collapsible framework; a cover arranged over the framework and forming an inlet and an outlet; and a fitting arranged blocking the inlet for attaching the guard to a suitable discharge port such as a faucet.

According to a preferred embodiment of the present invention, the framework is in the form of a resilient element coiled in the manner of a coiled spring. The cover is a sleeve constructed from a flexible material, and is arranged over the coiled resilient element.

The fitting advantageously includes a disc provided with a tapered central aperture, and a tapered coupling member mounted in the aperture. The disc is fitted in the inlet end of the coiled resilient element and retained therein by an end coil of the framework.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a fragmentary, perspective view showing a splash guard according to the present invention arranged in a sink associated with an appliance filling and draining faucet attachment.

FIG. 2 is a side elevational view, partly cut away and in section, showing a splash guard according to the present invention.

FIG. 3 is a top plan view showing the splash guard of FIG. 2.

FIG. 4 is a side elevational view showing the splash guard of FIGS. 2 and 3 in its collapsed mode.

DESCRIPTION OF THE PREFERRED EMBODIMENT

Referring now more particularly to FIG. 1 of the drawing, a splash guard 10 according to the present invention is shown connected to a conventional filling and draining faucet attachment 12 itself attached to a faucet 14 of a conventional sink 16. Hoses 18 and 20 extend from attachment 12 to a, for example, dishwasher 22. While splash guard 10 is illustrated in FIG. 1 as merely resting on the bottom of sink 16, it is to be understood that the lower, or free, end of the splash guard may be inserted into or rest over drain 24 as desired.

Referring now more particularly to FIGS. 2 and 3 of the drawings, splash guard 10 includes a collapsible framework 26, a cover 28 aranged over framework 26 and forming an inlet and outlet, and a fitting 30 arranged blocking the inlet to framework 26 for facilitating attachment of guard 10 to attachment 12 or other suitable discharge port.

Framework 26 is advantageously a resilient element 32, such as a piece of spring wire, coiled in the manner of a conventional helical coiled spring. Cover 28 is a sleeve constructed from a suitable flexible material and arranged over the coiled resilient element 32.

Fitting 30 includes a disc 34 provided with a tapered central aperture 36 in which a tapered coupling member 38 is mounted. Coupling member 38 is illustrated as being a conventional tapered female hose fitting. Disc 34 is itself fitted in the inlet end of element 32 and retained thereby in end coil of element 32.

As can be seen from FIG. 4 of the drawings, framework 26 may be collapsed so that the coils of element 32 are arranged abutting one another in order to make guard 10 more compact for storage and for adjusting the length of the guard to a particular circumstance.

As will be readily appreciated from the above description and from the drawing, a splash shield or guard 10 according to the present invention may be fitted onto the water hose attachment of a conventional portable dishwasher, portable washing machine, and the like, so as to be connected to a sink faucet. The guard will prevent water from splashing as it comes from the machine into the sink wth a considerable amount of force. Cover 28 may be flexible tubing constructed from a suitable synthetic material, such as polyethylene or a synthetic rubber. Element 32 may be a suitable spring wire, as mentioned above. The flexible nature of cover 28 will permit it to fold in accordion pleats when element 32 is compressed so that the coils thereof abut one another. Disc 34 may be constructed from, for example, 1/16 inch nylon, and the like, with coupling member 38 being constructed from a suitable synthetic rubber, and the like.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination, a sink construction including a lower drain and a water faucet spaced above the sink, a combined filling and draining attachment for a water using domestic cleaning apparatus, said attachment being connected to said faucet for receiving water therefrom and including a water outlet in generally vertical registry with and opening downwardly toward said drain, an upstanding elongated flexible tube member of generally circular cross-sectional shape, said tube member being axially compressible and including means yieldingly biasing the tube member toward its maximum length fully extended condition, a fitting secured in, reinforcing and closing the upper end of said tube member and including means defining an inlet opening through said fitting into the upper end of said tube member and of a cross sectional area considerably smaller than the effective internal cross sectional area of said tube member, said fitting being sealingly connected to the outlet of said attachment for receiving the discharge of water from said cleaning apparatus, said tube member being of an effective length, when expanded toward its maximum length condition, greater than the spacing of said water outlet of said attachment above said drain, whereby the lower end of said tube member made be inserted into or rest over the drain.

2. The combination of claim 1 wherein said fitting includes a disc provided with an outer peripheral edge seated in the upper end of said tube member.

3. The combination of claim 1 wherein said tube is corrugated, the corrugations of said tube member being disposed in spiral arrangement therealong and said means biasing said tube member toward a fully extended condition comprises a coiled spring with its convolutions extending along and seated in said spiral corrugations.

* * * * *